US008646576B2

(12) United States Patent
Wurth et al.

(10) Patent No.: US 8,646,576 B2
(45) Date of Patent: Feb. 11, 2014

(54) FOLDABLE HOISTWAY WORK DECK

(75) Inventors: Steven P. Wurth, Sylvania, OH (US); Terry Rodebaugh, Whitehouse, OH (US)

(73) Assignee: Wurtec Elevator Products & Services, Toledo, OH (US)

( * ) Notice: Subject to any disclaimer, the term of this patent is extended or adjusted under 35 U.S.C. 154(b) by 385 days.

(21) Appl. No.: 12/838,544

(22) Filed: Jul. 19, 2010

(65) Prior Publication Data

US 2011/0024231 A1 Feb. 3, 2011

Related U.S. Application Data

(60) Provisional application No. 61/229,902, filed on Jul. 30, 2009.

(51) Int. Cl.
*E04G 3/24* (2006.01)

(52) U.S. Cl.
USPC ..... 182/113; 182/116

(58) Field of Classification Search
USPC ..... 182/128, 84, 152, 113, 115, 116
See application file for complete search history.

(56) References Cited

U.S. PATENT DOCUMENTS

| | | | | | |
|---|---|---|---|---|---|
| 1,714,044 | A * | 5/1929 | Pedersen | ..... | 182/113 |
| 3,664,458 | A * | 5/1972 | Sterns et al. | ..... | 182/102 |
| 4,276,957 | A * | 7/1981 | Kilgore | ..... | 182/130 |
| 4,453,619 | A * | 6/1984 | Bierman | ..... | 182/142 |
| 5,065,843 | A * | 11/1991 | Richards | ..... | 187/408 |
| 6,131,698 | A * | 10/2000 | Reyland | ..... | 182/82 |
| 7,108,100 | B2 | 9/2006 | Stingl | | |
| 2009/0314579 | A1 * | 12/2009 | Withers | ..... | 182/107 |

FOREIGN PATENT DOCUMENTS

| | | | | | |
|---|---|---|---|---|---|
| AU | 76084/91 | | 1/1992 | | |
| DE | 803075 | | 2/1951 | | |
| DE | 19928574 | | 1/2001 | | |
| FR | 2641018 | | 12/1988 | | |
| GB | 2224300 | A * | 5/1990 | ..... | E04G 1/15 |
| JP | 08165074 | A * | 6/1996 | ..... | B66B 7/00 |
| JP | 08310766 | A * | 11/1996 | ..... | B66B 7/00 |
| JP | 2000328777 | A * | 11/2000 | ..... | E04G 3/00 |
| JP | 2006103927 | A * | 4/2006 | ..... | B66B 7/00 |
| JP | 2011126628 | A * | 6/2011 | ..... | B66B 5/00 |

* cited by examiner

*Primary Examiner* — Charles A Fox
*Assistant Examiner* — Kristine Florio
(74) *Attorney, Agent, or Firm* — Fraser Clemens Martin & Miller LLC; Charles F. Charpie

(57) ABSTRACT

A work deck configured for use within an elevator hoistway is provided. The work deck includes a platform having a plurality of planks. A plurality of telescoping assemblies is pivotally connected to one end of the platform, the telescoping assemblies each configured to span the elevator hoistway such that a first end of the telescoping assemblies seats against a building floor and a second end of the telescoping assemblies seats against a hoistway structure. A ladder has a first end and a second end. The first end of the ladder is pivotally connected to the platform and the second end is pivotally connected to the first end of the telescoping assemblies. The platform is configured to provide a work deck for personnel for use within the elevator hoistway. The work deck can be folded into a substantially flat package for ease of shipment.

16 Claims, 7 Drawing Sheets

Fig. 1b
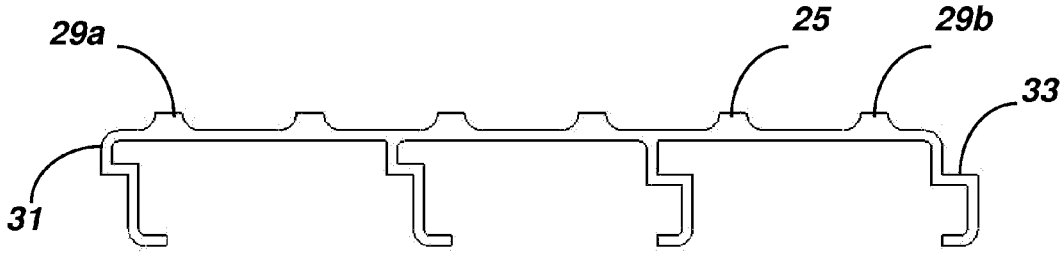
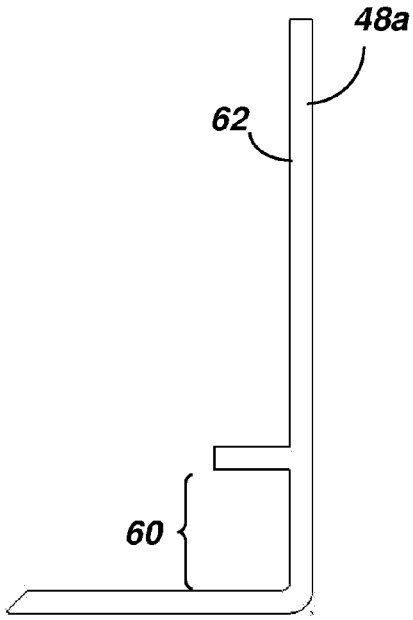
Fig. 1c 84
10
68
66
70
26
64
64
59
18
12
16
82
50
36
58
28
52
54
DH

FOLDABLE HOISTWAY WORK DECK

RELATED APPLICATIONS

This application claims the benefit of U.S. Provisional Application No. 61/229,902, filed Jul. 30, 2009, the disclosure of which is incorporated herein by reference.

BACKGROUND OF THE INVENTION

This invention relates in general to the construction of structures, such as for example, commercial buildings. More specifically, this invention relates to a construction apparatus configured for use within an elevator hoistway.

Structures, such as commercial buildings, can be built using a variety of construction materials and construction processes. In some construction processes, building floors and elevator hoistways within the buildings can be constructed very quickly. In some cases, the build-out of the lower building floors is started prior to the construction of the upper building floors. In these cases, various construction activities, such as for example, running of plumbing pipes, installation of electrical wires and installation of elevator guide rails, can occur prior to the construction of the upper building floors. Some of the various construction activities can be facilitated by work performed within the elevator hoistway by personnel positioned within the elevator hoistway.

It would be advantageous to provide a work deck that could be easily used within an elevator hoistway for performing construction activities.

SUMMARY OF THE INVENTION

The above objects, as well as other objects not specifically enumerated, are achieved by a work deck configured for use within an elevator hoistway. The work deck includes a platform having a plurality of planks. A plurality of telescoping assemblies is pivotally connected to one end of the platform, the telescoping assemblies each configured to span the elevator hoistway such that a first end of the telescoping assemblies seats against a building floor and a second end of the telescoping assemblies seats against a hoistway structure. A ladder has a first end and a second end. The first end of the ladder is pivotally connected to the platform and the second end is pivotally connected to the first end of the telescoping assemblies. The platform is configured to provide a work deck for personnel for use within the elevator hoistway. The work deck can be folded into a substantially flat package for ease of shipment.

According to this invention there is also provided a method of deploying a foldable work deck within an elevator hoistway. The method includes the steps of setting the length of a plurality of telescoping assemblies such that the telescoping assemblies span an elevator hoistway, positioning the foldable work deck on a desired floor, seating a sill angle on the foldable work deck against a building floor sill, rotating the foldable work deck toward a hoistway wall until the telescoping assemblies seat against the hoistway wall, rotating a platform to a substantially horizontal orientation and rotating a ladder to a substantially vertical position, connecting the ladder to the telescoping assemblies and connecting railings to the platform.

Various objects and advantages of the foldable hoistway work deck will become apparent to those skilled in the art from the following detailed description of the preferred embodiment, when read in light of the accompanying drawings.

BRIEF DESCRIPTION OF THE DRAWINGS

FIG. 1*b* is a side view in elevation of a plank of the foldable work deck of FIG. 1*a*.

FIG. 1*c* is a side view in elevation of a side member of the foldable work deck of FIG. 1*a*.

DETAILED DESCRIPTION OF THE INVENTION

The present invention will now be described with reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figure 1A:
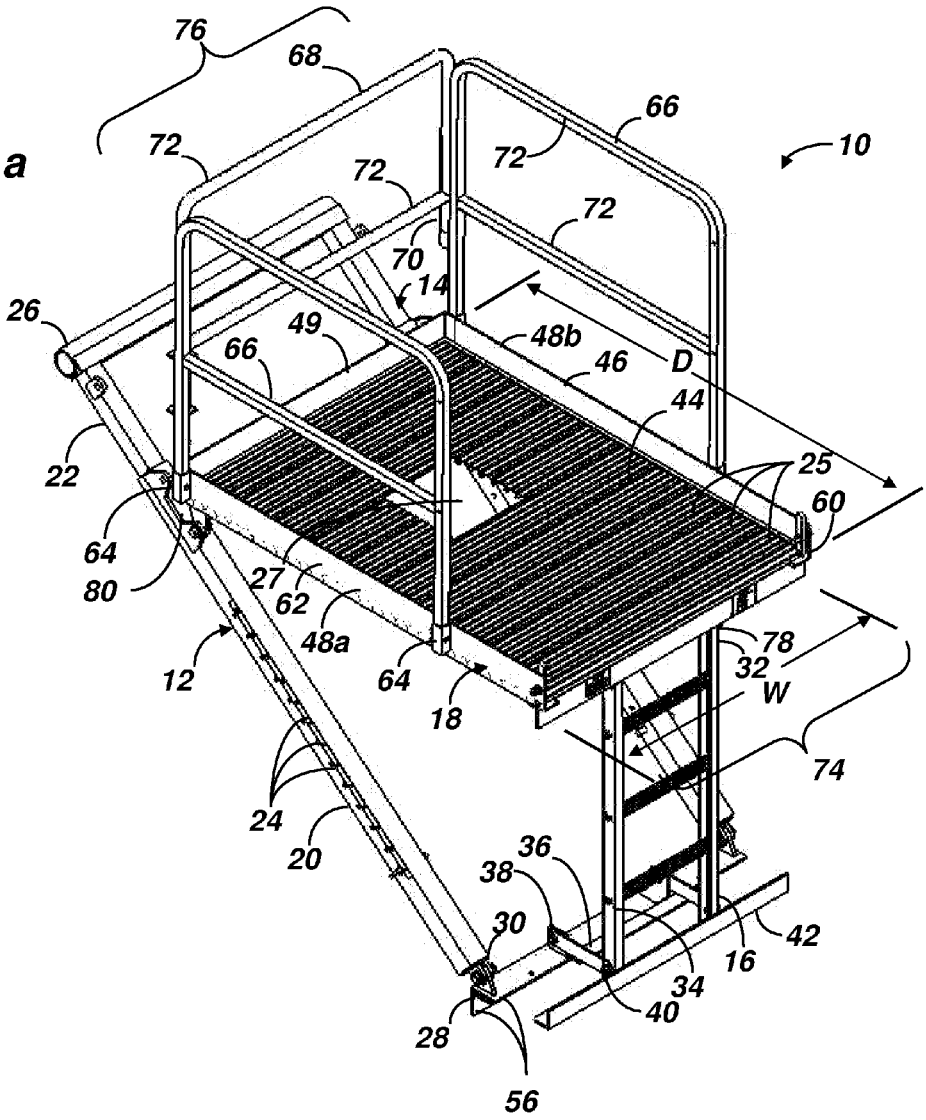
FIG. 1*a* is a perspective view of a first embodiment of a foldable work deck for use within an elevator hoistway.

Referring now to the drawings, there is illustrated in FIG. 1*a* a foldable work deck, indicated generally at 10, configured for use within an elevator hoistway of a building. The term "elevator hoistway," as used herein, is defined to mean a vertically-oriented space within a building, enclosed by walls and elevator doors, for the travel of one or more elevators, dumbwaiters, or material lifts. The term "work deck," as used herein, is defined to mean a platform configured for use by elevator personnel. As will be discussed in more detail below, the foldable work deck 10 is configured to provide a work platform for elevator personnel within the elevator hoistway of a building. The foldable work deck 10 is further configured for relocation to other portions of the elevator hoistway in a simple and easy manner.

Referring again to FIG. 1*a*, the foldable work deck 10 includes telescoping assemblies, 12 and 14, and a ladder 16 configured to support a platform 18. The telescoping assemblies, 12 and 14, each include a first member 20 and a cooperating second member 22. The first and second members, 20 and 22, of the telescoping assemblies, 12 and 14, are configured to extend to a desired length. As will be discussed in more detail below, the desired length of the combined first and second members, 20 and 22, is sufficient to span an elevator hoistway. In the illustrated embodiment, the second member 22 is configured to slidably extend and contract within the first member 20. However, the first and second members, 20 and 22, can be configured in any desired manner sufficient to allow the telescoping assemblies, 12 and 14, to slidably extend and contract to a desired length. In the illustrated embodiment, the first and second members, 20 and 22, are tubes having a square cross-sectional shape. However in other embodiments, the first and second members, 20 and 22, can be any structure and can have any desired cross-sectional shape, such as for example, a circular cross-sectional shape. The first and second members, 20 and 22, can be made from any desired materials, including the non-limiting example of steel. Further, the first and second members, 20 and 22, can have any surface finish or coating, such as for example, a rust-preventative coating. The first and second members, 20 and 22, each have a plurality of corresponding spaced apart apertures 24. In the illustrated embodiment, the corresponding apertures 24 are engaged by one or more retaining fixtures (not shown) configured to fix the telescoping assemblies, 12 and 14, in a desired length. The retaining fixtures can be any desired mechanism or device, including the non-limiting example of a clevis pin.

As shown in FIG. 1*a*, the telescoping assemblies, 12 and 14, each are fixed at one end to a support member 26. The support member 26 is configured to seat against a structure within the elevator hoistway. As shown in the embodiment illustrated in FIG. 2, the structure can be a hoistway wall 50. However, the structure can be other forms or assemblies within the elevator hoistway, such as for example, a structural dividing beam. Referring again to the embodiment illustrated in FIG. 1*a*, the support member 26 is a hollow tube having a circular cross-sectional shape. However, in other embodiments, the support member 26 can have other desired cross-sectional shapes, including the non-limiting example of a rectangular cross-sectional shape. In still other embodiments, the support member 26 can have other desired forms, such as for example, a pivoting foot. In the illustrated embodiment, the support member 26 is made from a metallic material, such as for example, steel. Alternatively, the support member 26 can be made from other materials, including the non-limiting examples of aluminum or reinforced polymeric materials. Further, the support member 26 can have any surface finish or coating, such as for example, a rust-preventative coating. In the illustrated embodiment, the telescoping assemblies, 12 and 14, are attached to the support member 26 by welding. However, the telescoping assemblies, 12 and 14, can be attached to the support member 26 in other desired manners, including the non-limiting manner of using mechanical fasteners.

Figure 2:
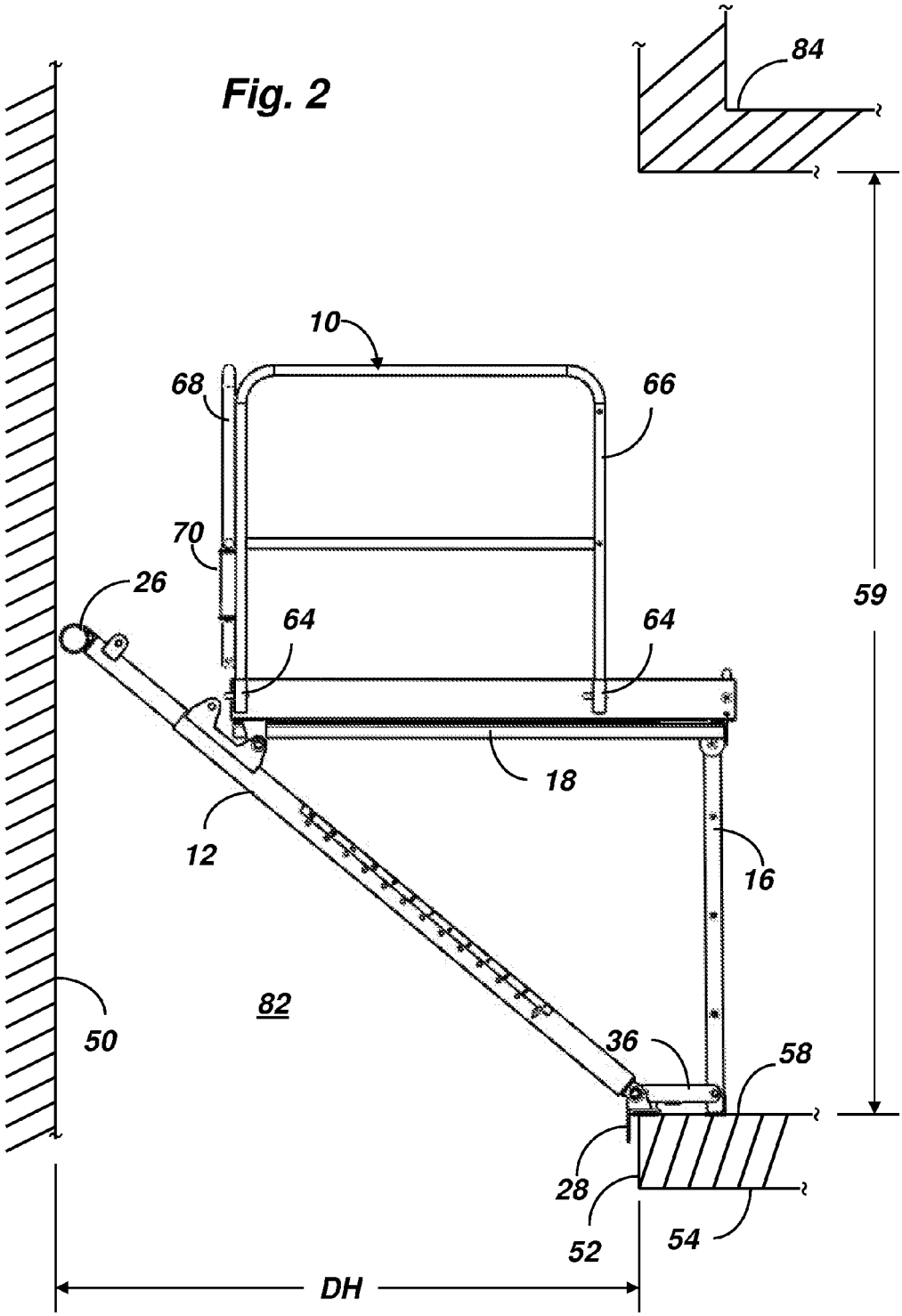
FIG. 2 is a side view in elevation of the foldable work deck of FIG. 1 shown in an installed position within an elevator hoistway.

Referring again to FIG. 1*a*, the other ends of the telescoping assemblies, 12 and 14, are pivotally connected to a sill angle 28. A portion of the sill angle 28 is configured to seat against a floor sill 52 of a building floor 54 as shown in FIG. 2. In the illustrated embodiment, the sill angle 28 includes legs 56 arranged in a substantially perpendicular orientation. The substantially perpendicular orientation of the legs 56 is configured to mate with the substantially perpendicular surfaces of the floor sill 52. However, the legs 56 of the sill angle 28 can have any desired orientation sufficient to mate with the surfaces of the floor sill 52. In the illustrated embodiment, the sill angle 28 is made from a metallic material, such as for example, steel. However, in other embodiments, the sill angle 28 can be made from other desired materials, including the non-limiting examples of aluminum and reinforced plastic. Additionally, the sill angle 28 can have any surface finish or coating, such as for example, a rust-preventative coating. The telescoping assemblies, 12 and 14, are pivotally connected to the sill angle 28 at the pivot points 30.

As shown in FIG. 1*a*, the ladder 16 is configured to support a portion of the platform 18. A first end 32 of the ladder 16 is configured to pivotally attach to the platform 18 and a second end 34 of the ladder 16 is configured to rest on a top surface 58 of the building floor 54. The second end 34 of the ladder 16 is pivotally connected to ladder links 36. The ladder links 36 are configured to pivotally connect the second end 34 of the ladder 16 to the sill angle 28. The ladder links 36 are connected to the sill angle 28 at pivot point 38 and connected to the ladder 16 at pivot point 40. In the illustrated embodiment, the ladder links 36 are made of a steel material and have a rectangular cross-sectional shape. However, the ladder links 36 can be made of other desired materials and can have other cross-sectional shapes.

Referring again to FIG. 1*a*, the second end 34 of the ladder 16 is connected to a base member 42. The base member 42 is configured to seat against the top surface 58 of the building floor 54. In the illustrated embodiment, the base member 42 is a structural angle. However, the base member 42 can be any desired shape or material.

The platform 18 includes a platform surface 44 supported by a frame assembly 46. The platform surface 44 is removable and configured to provide a supporting surface for personnel working within an elevator hoistway. In the illustrated embodiment, the platform surface 44 is formed from overlapping planks 25. However, the platform surface 44 can be formed from other desired structures. In the illustrated embodiment, the planks 25 forming the platform surface 44 are oriented such as to form an aperture 27 within the platform surface 44. The aperture 27 is configured to allow passage of components or devices, including the non-limiting example of hoist cables to pass through the platform surface 44. The aperture 27 can have any desired size and shape. While the embodiment shown in FIG. 1*a* illustrates an aperture 27 formed within the platform surface 44, it should be appreciated that the aperture 27 is optional and that the foldable work deck 10 may be practiced without the aperture 27.

Referring now to FIG. 1*c*, a plank 25 is illustrated. The plank 25 includes a first side 29*a* and a second side 29*b*. The first side 29*a* of the plank 25 includes a protrusion 31 and the second side 29*b* includes a recess 33. In operation, the planks 25 are arranged on the platform surface 44, as shown in FIG. 1*a*, such that the protrusion 31 of a first plank 25 is seated in the recess 33 of an adjacent plank 25, thereby creating the overlapping arrangement of the planks 25. In the illustrated embodiment, the plank 25 is made from a metallic material, such as for example, aluminum. Alternatively, the plank 25 can be made from other materials, including the non-limiting example of reinforced polymeric materials.

Referring again to FIG. 1*a*, the platform 18 has a platform depth D and a platform width W. Generally, the platform depth D and the platform width W can be configured to accommodate the depth and width of an elevator hoistway within which the platform 10 is to be used. In the illustrated embodiment, the platform depth D is in a range of from about 72.0 inches to about 96.0 inches and the platform width W is in a range of from about 42.0 inches to about 75.0 inches. Alternatively, the platform depth D can be less than about 72.0 inches or more than about 96.0 inches and the platform width W can be less than about 42.0 inches or more than about 75.0 inches.

The frame assembly 46 includes opposing side members 48*a* and 48*b* and end member 49. In the illustrated embodiment, the opposing side members 48*a* and 48*b* are connected to the end member 49 by mechanical fasteners. However, in other embodiments, the opposing side members 48*a* and 48*b* can be connected to the end member 49 in other desired manners, including the non-limiting example of welding.

Referring now to FIG. 1*c*, a cross-sectional view of the side members 48*a* and 48*b* and the end member 49 is illustrated. For purposes of simplicity, only the side member 48*a* is shown. The side member 48*a* includes a platform channel 60 and a kick surface 62. The platform channel 60 is configured to contain and support an end of the platform surface 44. The platform channel 60 can have any desired configuration, such as a U-shaped channel.

The kick surface 62 is configured to extend from the platform channel 60 and provide a fall barrier for personnel and parts positioned on the platform 18. The kick surface 62 can have any desired height and configuration.

Referring again to FIG. 1*a*, the opposing side members 48*a* and 48*b* include a plurality of fixtures 64. The fixtures 64 are configured to hold side railings 66 in a generally vertical orientation. In the illustrated embodiment, the fixtures 64 are U-shaped members corresponding to the square cross-sectional shape of the side railings 66. However, the fixtures 64 can have other desired shapes and configurations. The fixtures 64 can be attached to the frame assembly 46 in any desired manner, such as for example, using mechanical fasteners.

As shown in FIGS. 1*a* and 2, the opposing side members 48*a* and 48*b* include a plurality of fixtures 70 configured to hold end railing 68 in position. In the illustrated embodiment, the fixtures 70 are circular-shaped members corresponding to the circular cross-sectional shape of the end railing 68. However, the fixtures 70 can have other desired shapes and configurations. The fixtures 70 can be attached to the side members 48*a* and 48*b* in any desired manner, such as for example, using mechanical fasteners.

The side railings 66 and the end railing 68 are configured for the safety of personnel positioned on the platform 18. While the embodiment of the side railings 66 and the end railing 68 illustrated in FIG. 1*a* shows a configuration having a plurality of cross-bars 72 and generally open spaces between the cross-bars 72, the side railings 66 and the end railing 68 can have any desired configuration, including a configuration having material, such as for example, screening between the cross-bars 72. Any desired quantity of cross-bars 72 can be used.

Referring again to FIG. 1*a*, the platform 18 includes an open end 74 and a closed end 76. The open end 74 of the platform 18 is pivotally connected to the first end 32 of the ladder 16 at pivot point 78. The closed end 76 of the platform 18 is pivotally connected to the telescoping assemblies 12 and 14 at pivot point 80.

Referring now to FIG. 2, the foldable work deck 10 is illustrated in an installed position within the hoistway 82 of a building 84. The building 84 includes a plurality of building floors 54 (for purposes of clarity only one building floor 54 is shown). The building 84 can have any desired number of building floors 54. Each building floor 54 includes the floor sill 52, the top surface 58 and an entrance 59. In the illustrated embodiment, the building floor 54 is constructed of reinforced concrete and has a thickness of approximately 10.0 inches. However, the building floor 54 can be constructed of any suitable material or combination of materials, such as for example, building steel, and can have a thickness of more or less than 10.0 inches.

The entrance 59 separates the building floor 54 from the elevator hoistway 82 and provides an opening through which passengers can enter an elevator (not shown). The entrance 59 can have various sizes, shapes, thicknesses, and configurations which are well known in the art.

Referring again to FIG. 2, the elevator hoistway 82 is bounded on one side by the entrance 59 and on the other side by the hoistway wall 50. The hoistway wall 50 extends from the bottom of the hoistway 82 to the top of the hoistway 82. In the illustrated embodiment, the hoistway wall 50 is constructed of reinforced concrete and has a thickness of approximately 10.0 inches. However, the hoistway wall 50 can be constructed of any appropriate materials, such as for example, concrete block, and can have a thickness of more or less than 10.0 inches.

The elevator hoistway 82 has a horizontal distance DH extending from the hoistway wall 50 to the elevator entrance 59. In the illustrated embodiment, the horizontal distance DH is approximately 8.0 feet. However in other embodiments, the horizontal distance DH can be more or less than approximately 8.0 feet.

Referring again to FIG. 2, it can be seen that the telescoping assemblies 12 and 14 of the foldable work deck 10 are configured to span the horizontal distance DH of the elevator hoistway 82, with the sill angle 28 seated against the floor sill 52 and the support member 26 seated against the hoistway wall 50 (for purposes of clarity only telescoping assembly 12 is illustrated in FIG. 2). The telescoping members 12 and 14 can have any desired length that is longer than the horizontal distance DH of the elevator hoistway 82, ensuring the telescoping members 12 and 14 are positioned in an inclined orientation.

As shown in FIG. 2, the telescoping members 12 and 14 and the ladder 16 support the platform 18 as the platform 18 is positioned in a substantially horizontal orientation. In this position, the foldable work deck 10 is configured to provide a work platform within the elevator hoistway 82 of the building 84.

Figure 3:
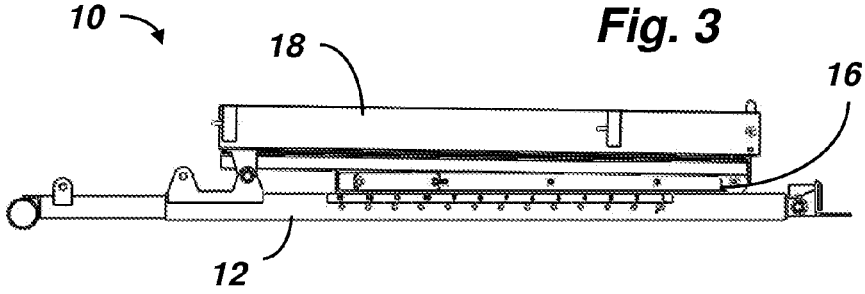
FIG. 3 is a side view in elevation of the foldable work deck of FIG. 1 shown in a folded orientation.

Referring now to FIG. 3, the foldable work deck 10 is shipped to the building in a folded configuration. The folded configuration includes removing the side railings 66 and the end railing 68, and rotating the ladder 16 and the platform 18 such that the ladder 16 is positioned between the telescoping assemblies 12 and 14 and the platform 18. The folded configuration of the foldable work deck 10 advantageously provides a substantially flat shipping package. As will be explained in more detail below, the folded configuration of the foldable work deck 10 further allows the foldable work deck 10 to be hoisted within the elevator hoistway 82 in an easy manner.

Figure 4A:
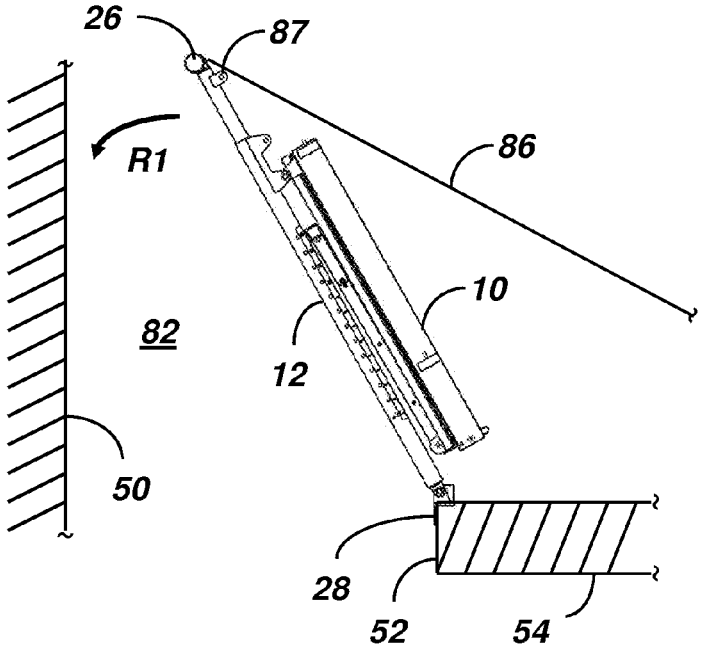
FIG. 4*a* is a side view in elevation of the foldable work deck of FIG. 1 illustrated in a first installation step.
Figure 4B:
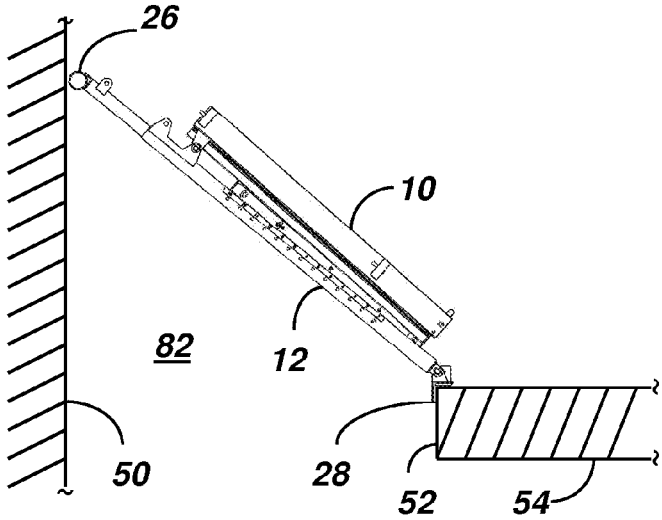
FIG. 4*b* is a side view in elevation of the foldable work deck of FIG. 1 illustrated in a second installation step.

Referring now to FIGS. 4*a*-4*d*, the steps of deploying the foldable work deck 10 from the folded configuration are illustrated. Referring initially to FIGS. 4*a* and 4*b*, the operator sets the length of the telescoping members 12 and 14 corresponding to the hoistway distance as described above. Next, the operator locates the foldable work deck 10 at a desired floor 54. The operator connects a line 86 to an optional lift lug 87. Next, the operator seats the sill angle 28 of the foldable work deck 10 against the floor sill 52 of the floor 54. Optionally, the sill angle 28 can be fastened to the floor sill 52 by fasteners (not shown). The foldable work deck 10, in the folded configuration, is rotated in the direction indicated by arrow R1 toward the hoistway wall 50 as the operator maintains tension in the line 86. The foldable work deck 10 continues to rotate in direction R1 toward the hoistway wall 50 until the support member 26 seats against the hoistway wall 50 as shown in FIG. 4*b*. Optionally, the line 86 can be used to decrease the load on the hoistway wall 50 by attaching the line to supports (not shown) positioned above the foldable work deck 10 or on the floor 54. Once the foldable work deck 10 is positioned such that the support member 26 is seated against the hoistway wall 50 and the sill angle 28 is seated against the floor sill 52, the foldable work deck 10 can be deployed for use within the hoistway 82.

Figure 4C:
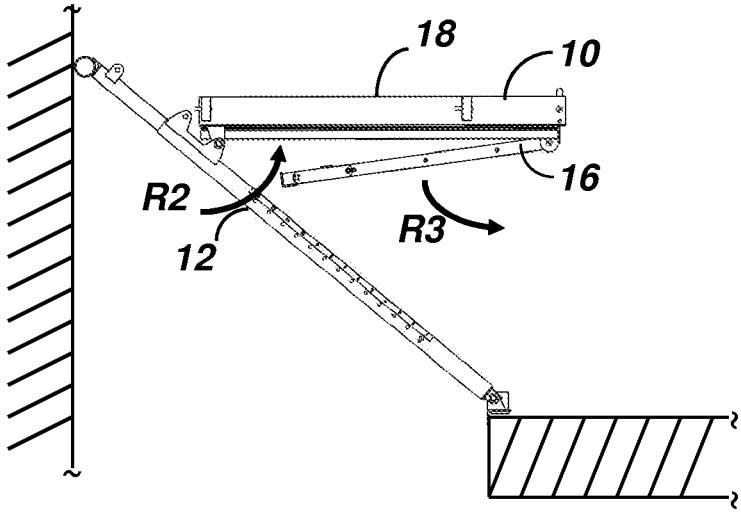
FIG. 4*c* is a side view in elevation of the foldable work deck of FIG. 1 illustrated in a third installation step.

Referring now to FIG. 4*c*, the platform 18 is rotated in a direction indicated by arrow R2 to a substantially horizontal orientation and the ladder 16 is rotated in a direction indicated by arrow R3 to a substantially vertical position.

Figure 4D:
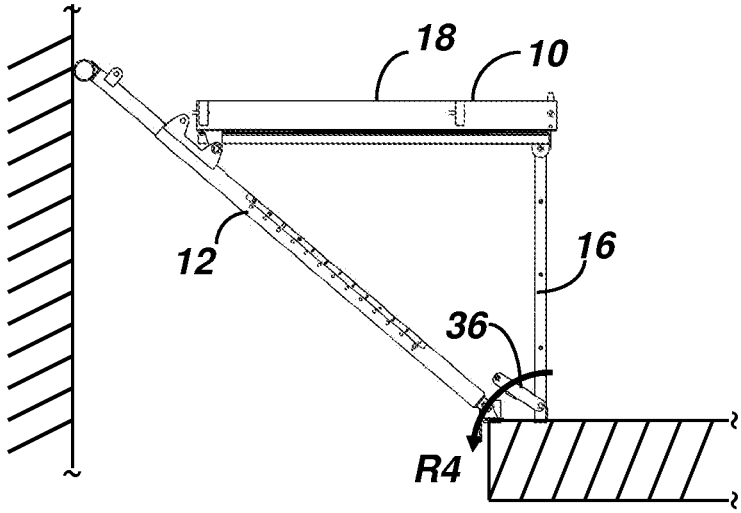
FIG. 4*d* is a side view in elevation of the foldable work deck of FIG. 1 illustrated in a fourth installation step.

Referring now to FIG. 4*d*, the ladder links 36 are rotated in a direction indicated by the arrow R4 such that the ladder links 36 connect the ladder 18 to the telescoping assemblies 12 and 14. Optionally, the base member (not shown) can be fastened to the floor sill 52 by fasteners.

In a final step as shown in FIG. 2, the side railings 66 are connected to the fixtures 64 and the end railing 68 is connected to the side railings 66. The foldable work deck 10 can be returned to the folded configuration by reversing the above described deployment process. The deployment process for the foldable work deck 10 advantageously provides that the foldable work deck 10 can be relocated to other portions of the elevator hoistway in a simple and easy manner.

Figure 5:
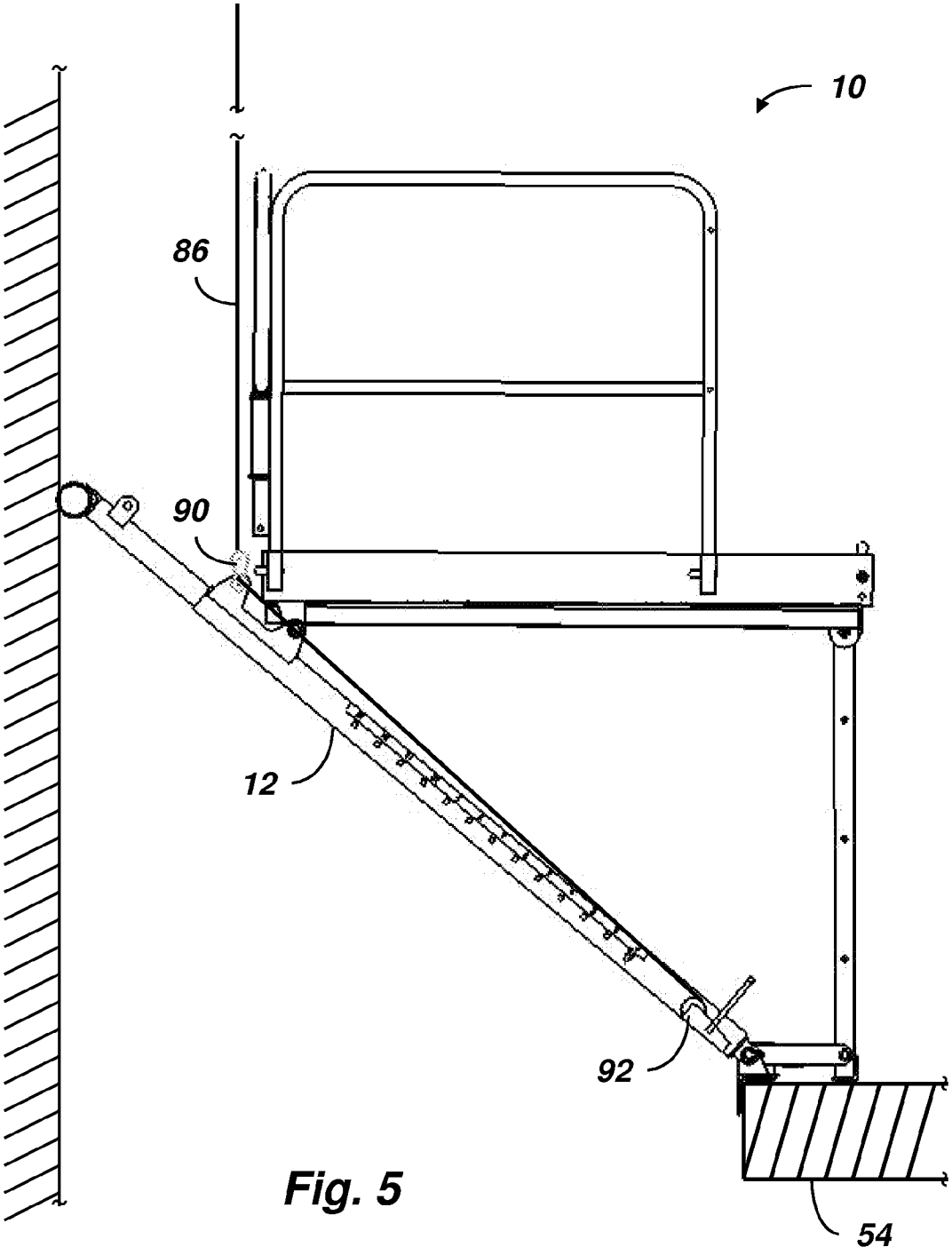
FIG. 5 is a side view in elevation of the foldable work deck of FIG. 1 illustrated with an optional hoist line.

Referring now to FIG. 5, optionally the foldable work deck 10 can include structures, mechanisms and devices configured to lift the foldable work deck 10 to other building floors 54. In the illustrated embodiment, the foldable work deck 10 includes a pulley 90 connected to the telescoping assembly 12 and a take-up mechanism 92. One end of the line 86 is connected to at least one support (not shown) positioned above the foldable work deck 10. The other end of the line 86 is connected to the take-up mechanism 92. The foldable work deck 10 can be returned to the folded configuration as described above and hoisted to the desired building floor 54 by the take-up mechanism 92. Once the foldable work deck 10 is positioned at the desired building floor 54, the foldable work deck 10 can be deployed as described above. In the illustrated embodiment, the take-up mechanism is a manually operated winch. However, in other embodiments, the take-up mechanism 92 can be other structures, mechanisms or devices, including the non-limiting example of a powered winch, sufficient to hoist the folded work deck 10 to other positions. While the illustrated embodiment includes a pulley 90 and a take-up mechanism 92, it should be appreciated that the foldable work deck 10 can be fitted with other structures, mechanisms and devices configured for hoisting the foldable work deck.

Figure 6:
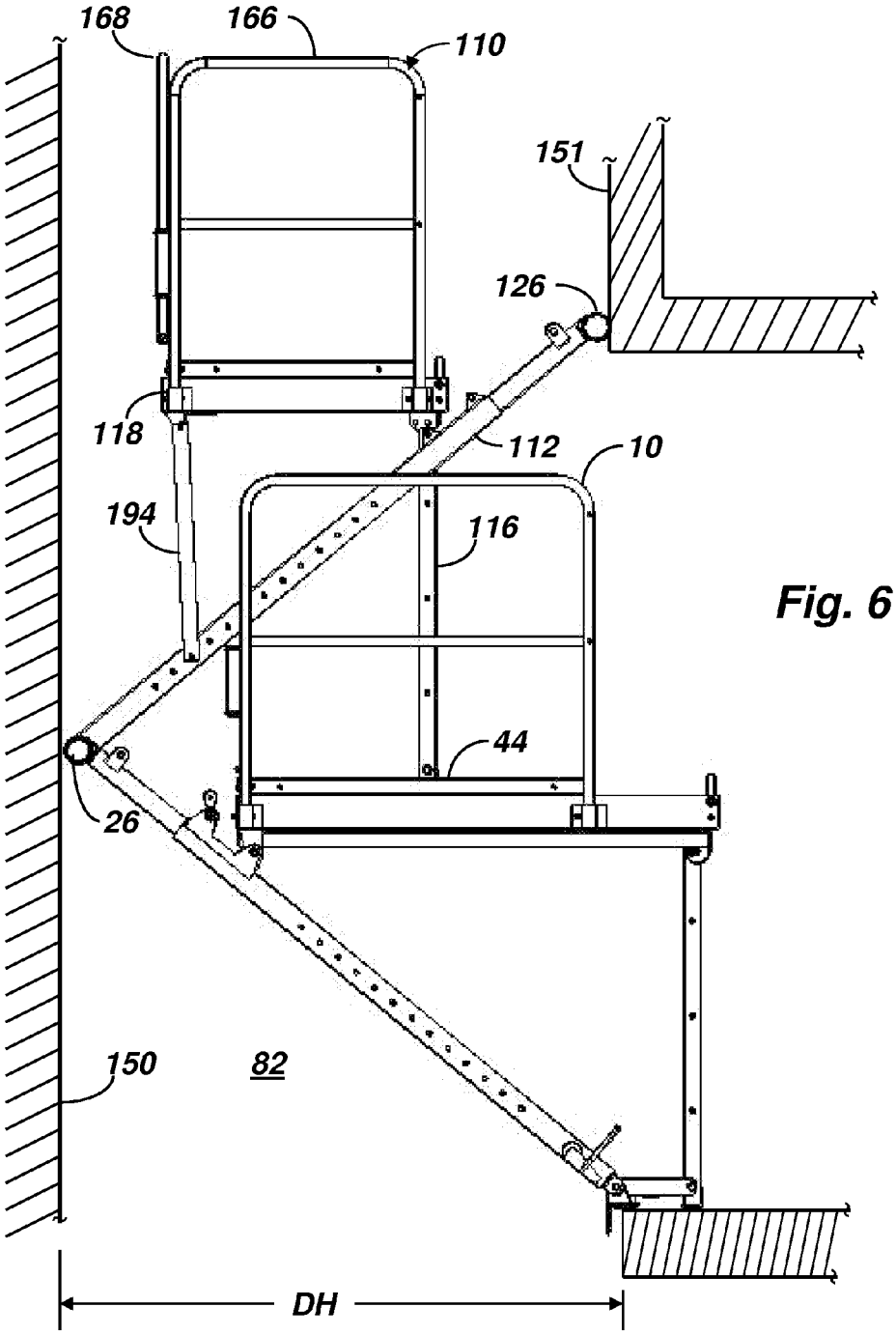
FIG. 6 is a side view in elevation of a second embodiment of a foldable work deck having a second work deck.

A second embodiment of a foldable work deck is shown generally in FIG. 6. In this embodiment, a second foldable work deck 110 is attached to the foldable work deck 10, thereby providing multiple work decks within the hoistway 82.

Referring again to the embodiment illustrated in FIG. 6, the foldable work deck 10 is the same as, or similar to, the foldable work deck 10 illustrated in FIGS. 1 and 2 and described above. Alternatively, the foldable work deck 10 can be different than the foldable work deck 10 illustrated in FIGS. 1 and 2 and described above. A plurality of telescoping assemblies 112 and 114 (for purposes of simplicity, only the telescoping assembly 112 is illustrated) is positioned to span the hoistway distance DH. One end of the telescoping assemblies 112 and 114 is connected to the support member 26 of the foldable work deck 10. The telescoping assemblies 112 and 114 can be connected to the support member 26 in any desired manner.

The other end of the telescoping assemblies 112 and 114 is connected to a support member 126. In the illustrated embodiment, the support member 126 is the same as, or similar to, the support member 26 illustrated in FIGS. 1 and 2 and described above. However, the support member 126 can be different from the support member 26. The support member 126 is configured to seat against a structure within the elevator hoistway. In the embodiment illustrated in FIG. 6, the structure is a hoistway wall 151. However, the structure can have other forms or assemblies within the elevator hoistway, such as for example, a dividing beam. In the inclined position as shown in FIG. 6, the telescoping members 112 and 114 are configured to support a portion of the second foldable work deck 110.

The second foldable work deck 110 includes a platform 118, side railings 166 and an end railing 168. In the illustrated embodiment, the platform 118, side railings 166 and end railing 168 are the same as, or similar to, the platform 18, side railings 66 and end railing 68 illustrated in FIGS. 1 and 2 and described above. Alternatively, the platform 118, side railings 166 and end railing 168 can be different.

A portion of the platform 118 is supported by a ladder 116. The ladder 116 is configured to seat against the platform surface 44 of the foldable work deck 10 and provide a structure for access to the platform 118 of the second foldable work deck 110 from the platform surface 44 of the foldable work deck 10. Optionally, the ladder 116 can be fastened to the platform surface 44 by fasteners (not shown). In the illustrated embodiment, the ladder 116 is the same as or similar to the ladder 16 illustrated in FIGS. 1 and 2 and described above. However, the ladder 116 can be different from the ladder 16.

Referring again to FIG. 6, another portion of the platform 118 is supported by a plurality of struts 194 (for purposes of clarity, only one strut 194 is illustrated). The struts 194 are configured for attachment to the platform 118 and to the telescoping members 112 and 114. In the illustrated embodiment, the struts 194 are structural members having an "L" shaped cross-sectional shape. However, the struts 194 can be other desired structures, mechanisms or devices and can have other cross-sectional shapes.

The platform 118, supported in a substantially horizontal orientation by the struts 194 and the ladder 116, is configured to provide a second work deck for personnel within the hoistway 82. The second foldable work deck 110 can be hoisted, deployed and returned to a folded configuration in the same or similar manner to that described above for the foldable work deck 10.

The principle and mode of operation of the foldable work deck have been described in its preferred embodiments. However, it should be noted that the foldable work deck may be practiced otherwise than as specifically illustrated and described without departing from its scope.

What is claimed is:

1. A work deck configured for use within an elevator hoistway, the work deck comprising:

a platform having a plurality of planks;

a plurality of telescoping assemblies pivotally connected to one end of the platform, the telescoping assemblies each configured to span the elevator hoistway such that a first end of the telescoping assemblies is connected to a sill angle, the sill angle configured to mate with perpendicular surfaces forming a floor sill, and a second end of the telescoping assemblies seats against a hoistway structure;

a ladder having a first end and a second end, the first end of the ladder pivotally connected to the platform and the second end configured to rest on a top surface of the building floor; and a plurality of ladder links configured to connect the second end of the ladder to the sill angle;

wherein the platform is configured to provide a work deck for personnel for use within the elevator hoistway, wherein the platform, the plurality of telescoping assemblies and the ladder can be folded into a single substantially flat package for ease of shipment such that in a folded configuration, the ladder is positioned between the telescoping assemblies and the platform.

2. The work deck of claim 1, wherein the telescoping assemblies each include a second member configured to slidably extend and contract within a first member.

3. The work deck of claim 2, wherein the first member and the second member have a square cross-sectional shape.

4. The work deck of claim 1, wherein the first ends of the telescoping assemblies are fixed to a support member, and wherein the support member has a circular cross-sectional shape.

5. The work deck of claim 1, wherein a base member is positioned between the second end of the ladder and the top surface of a building floor.

6. The work deck of claim 1, wherein the planks are supported by a frame assembly, wherein the frame assembly includes side members, and wherein the side members have a platform channel configured to receive the planks and a kick surface.

7. The work deck of claim 6, wherein the side members are connected to an end member, and wherein the end member has a platform channel configured to receive the planks and a kick surface.

8. The work deck of claim 6, wherein the side members include a plurality of fixtures configured to receive side railings.

9. The work deck of claim 1, wherein the planks are overlapping.

10. The work deck of claim 1, wherein the platform includes an aperture configured for passage of hoist cables.

11. The work deck of claim 1, wherein the platform has an adjustable platform depth and platform width, and wherein the platform depth is adjustable in a range of from about 72.0 inches to about 96.0 inches, and wherein the platform width is adjustable in a range of from about 42.0 inches to about 75.0 inches.

12. The work deck of claim 1, wherein the work deck is configured for rotation to a folded configuration for shipping.

13. The work deck of claim 1, wherein a take-up mechanism is attached to the telescoping assemblies and configured for hoisting the work deck to another location within the elevator hoistway.

14. The work deck of claim 13, wherein the take-up mechanism is a manual winch.

15. The work deck of claim 1, wherein a second work deck is attached to the work deck.

16. The work deck of claim 15, wherein the second work deck includes a platform, telescoping assemblies and a ladder.

* * * * *